US005898445A

United States Patent [19]

Becker et al.

[11] Patent Number: 5,898,445

[45] **Date of Patent: *Apr. 27, 1999**

[54] TRANSLATIONAL WIPING TECHNIQUE FOR A STATIONARY INKJET PRINTHEAD

[75] Inventors: Richard A. Becker, Barcelona, Spain; Arthur K. Wilson, San Diego, Calif.; William S. Osborne, Vancouver, Wash.

[73] Assignee: Hewlett-Packard Company, Palo Alto, Calif.

[ * ] Notice: This patent is subject to a terminal disclaimer.

[21] Appl. No.: 08/398,709

[22] Filed: Mar. 6, 1995

[51] Int. Cl.[6] ..... B41J 2/165

[52] U.S. Cl. ..... 347/33; 347/32

[58] Field of Search ..... 347/22, 29, 30, 347/32, 33

[56] References Cited

U.S. PATENT DOCUMENTS

| | | | |
|---|---|---|---|
| 4,577,203 | 3/1986 | Kawamura | 347/30 |
| 5,103,244 | 4/1992 | Gast et al. | 347/33 |
| 5,115,250 | 5/1992 | Harmon et al. | 347/33 |
| 5,148,203 | 9/1992 | Hirano | 347/30 |
| 5,151,715 | 9/1992 | Ward et al. | 347/33 |
| 5,155,497 | 10/1992 | Martin et al. | 347/33 |
| 5,182,582 | 1/1993 | Okamura | 347/33 |
| 5,432,539 | 7/1995 | Anderson | 347/33 |
| 5,440,331 | 8/1995 | Grange | 347/32 |
| 5,450,105 | 9/1995 | Dangelo | 347/30 |
| 5,614,930 | 3/1997 | Osborne et al. | 347/33 |

FOREIGN PATENT DOCUMENTS

| | | | |
|---|---|---|---|
| 0585901 | 3/1994 | European Pat. Off. . | |
| 0673772 | 9/1995 | European Pat. Off. . | |
| 59-45163 | 3/1984 | Japan | 347/33 |
| 401275049 | 11/1989 | Japan . | |
| 402179757 | 7/1990 | Japan . | |
| 3-253347 | 11/1991 | Japan | 347/33 |
| 4-187445 | 7/1992 | Japan | 347/33 |
| 6-134998 | 5/1994 | Japan | 347/33 |

OTHER PUBLICATIONS

Hewlett–Packard Journal dated Feb. 1994, "Print Cartridge Fixturing and Maintenance in the HP DeskJet 1200C Printer" by Michael T. Dangelo, Reza Movaghar, and Arthur K. Wilson.

*Primary Examiner*—N. Le
*Assistant Examiner*—Thien Tran
*Attorney, Agent, or Firm*—David S. Romney; Jerry R. Potts

[57] ABSTRACT

An inkjet printer has a printhead mounted in a carriage which periodically moves along a printhead path in a carriage scan direction to a stop position in a service station where an actuation device imparts translational motion to a wiper blade. The wiper blade moves along a linear wiping path orthogonal to the printhead path and across ink orifices on a nozzle surface of the printhead during a wiping operation. The wiper blade is removably mounted on a base and is split to form a first blade for wiping one column of ink orifices and a second blade for simultaneously wiping another column of ink orifices on a nozzle surface of the printhead. In a preferred form of the invention, the service station provides different sequential wiping steps with successive wiper blades by first drawing ink onto the nozzle surface from the ink orifices with a rounded blade edge of a leading wiper blade, and then wiping the ink from the nozzle surface with a sharp blade edge of a following wiper blade. The sequential wiping steps are repeated twice during a normal wiping cycle—once when the wiper blades leave a parking location to wipe across the stationary printhead, and again when the wiper blades change direction to wipe back across the same stationary printhead to return to the parking location located away from the printhead path.

25 Claims, 16 Drawing Sheets

| INKJET CARTRIDGES | FIRST SERVICE STATION | | | SECOND SERVICE STATION | | | |
|---|---|---|---|---|---|---|---|
| BLACK PRINTHEAD | SPIT | WIPE | SCRAPE | CAP | PRIME | – | – |
| CYAN PRINTHEAD | SPIT | – | – | CAP | PRIME | WIPE | SCRAPE |
| MAGENTA PRINTHEAD | SPIT | – | – | CAP | PRIME | WIPE | SCRAPE |
| YELLOW PRINTHEAD | SPIT | – | – | CAP | PRIME | WIPE | SCRAPE |

TRANSLATIONAL WIPING TECHNIQUE FOR A STATIONARY INKJET PRINTHEAD

RELATED APPLICATIONS

This application is related to the following copending applications, all of which are assigned to the same assignee as the present case and are incorporated herein by reference:

- Ser. No. 08/145,261 entitled MIXED RESOLUTION PRINTING FOR COLOR AND MONOCHROME PRINTERS filed in the names of Donald G. Harris et al. on Oct. 29, 1993;
- Ser. No. 08/056,326 entitled MANUAL PEN SELECTION FOR CLEARING NOZZLES WITHOUT REMOVAL FROM PEN CARRIAGE filed in the name of Michael T. Dangelo on Apr. 30, 1993, now U.S. Pat. No. 5,450,105, granted Sep. 12, 1995;
- Ser. No. 08/225,039 entitled WIPING SYSTEM FOR INKJET PRINTER filed in the names of William H. Schwiebert et al. on Apr. 8, 1994;
- Ser. No. 08/224,918 entitled WET-WIPING TECHNIQUE FOR INKJET PRINTHEAD filed in the names of Amy Van Liew et al. on Apr. 8, 1994;
- Ser. No. 08/330,461 entitled ORTHOGONAL ROTARY WIPING SYSTEM FOR INKJET PRINTHEADS filed in the names of William S. Osborne, et al. on Oct. 28, 1994;
- Ser. No. 08/339,397 entitled CUSTOMIZED PRINTHEAD SERVICING FOR DIFFERENT PRINTER CONDITIONS filed in the names of Paul E. Martinson et al. on Mar. 6, 1995:
- Ser. No. 08/398,720 entitled ACTUATION MECHANISM FOR TRANSLATIONAL WIPING OF A STATIONARY INKJET PRINTHEAD filed in the names of David C. Burney, et al on Mar. 6, 1995;
- Ser. No. 08/399,380 entitled INDEPENDENT WIPING/SPITTING STATION FOR INKJET PRINTHEAD filed in the names of Richard A. Becker, et al. on Mar. 6, 1995.

BACKGROUND OF THE INVENTION

This application relates generally to inkjet printing, and more particularly to online service station functions of spitting ink into a spittoon, wiping ink orifices, capping an array of nozzles on a printhead, and priming inkjet cartridges.

Some prior color inkjet pen cartridges functioned somewhat satisfactorily with no wiping and minimal capping. Other prior monochrome/color inkjet cartridges used in single cartridge printers were wiped and capped with relatively simple mechanisms of the type shown in U.S. Pat. No. 4,583,717. Complex problems arose when trying to service different types of printheads on multiple ink cartridges mounted together in a print carrriage, particularly when the ink cartridges have different types of color/black inks.

BRIEF SUMMARY OF THE INVENTION

An inkjet printer has a printhead mounted in a carriage which periodically moves along a printhead path in a carriage scan direction to a stop position in a service station where an actuation device imparts translational motion to a wiper blade. The wiper blade moves along a linear wiping path orthogonal to the printhead path and across ink orifices on a nozzle surface of the printhead during a wiping operation. The wiper blade is removably mounted on a base and is split to form a first blade for wiping one column of ink orifices and a second blade for simultaneously wiping another column of ink orifices on a nozzle surface of the printhead.

In a preferred form of the invention, the service station provides different sequential wiping steps with successive wiper blades by first drawing ink onto the nozzle surface from the ink orifices with a rounded blade edge of a leading wiper blade, and then wiping the ink from the nozzle surface with a sharp blade edge of a following wiper blade. The sequential wiping steps are repeated twice during a normal wiping cycle—once when the wiper blades leave a parking location to wipe across the stationary printhead, and again when the wiper blades change direction to wipe back across the same stationary printhead to return to the parking location located away from the printhead path.

DETAILED DESCRIPTION OF PREFERRED EMBODIMENTS

In a presently preferred embodiment of the invention disclosed herein, we have combined a 600 dpi ½ inch swath black pen with three 300 dpi color pens each generating a swath of approximately ⅓ inch. The high performance black pen has pigment based ink and is typically used for printing text and other "black only" features, and thus the output quality and throughput of these features is greater. It also improves the output quality of color graphics and color features by teaming with the three lower resolution color pens which have dye based inks for printing color graphics or color features. The black component of the graphics is often a large portion of color graphics content is at a higher resolution and thus at a higher output quality level. The larger swath of the black pen can thus be combined with printing algorithms to improve the throughput of color graphics.

Figure 1:
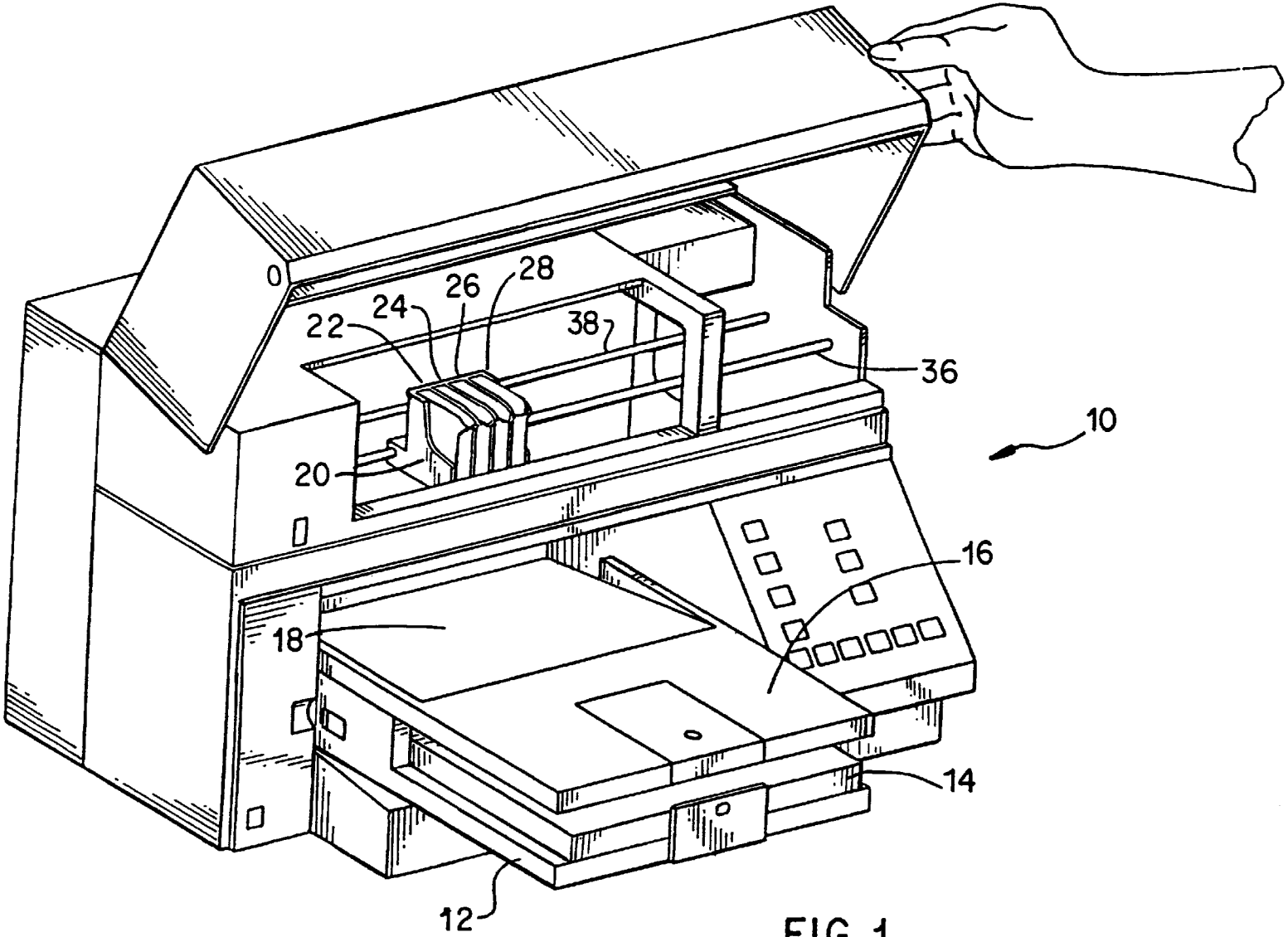
FIG. 1 is a perspective view of a type of inkjet printer which can incorporate the service station features of the present invention.
Figure 2:
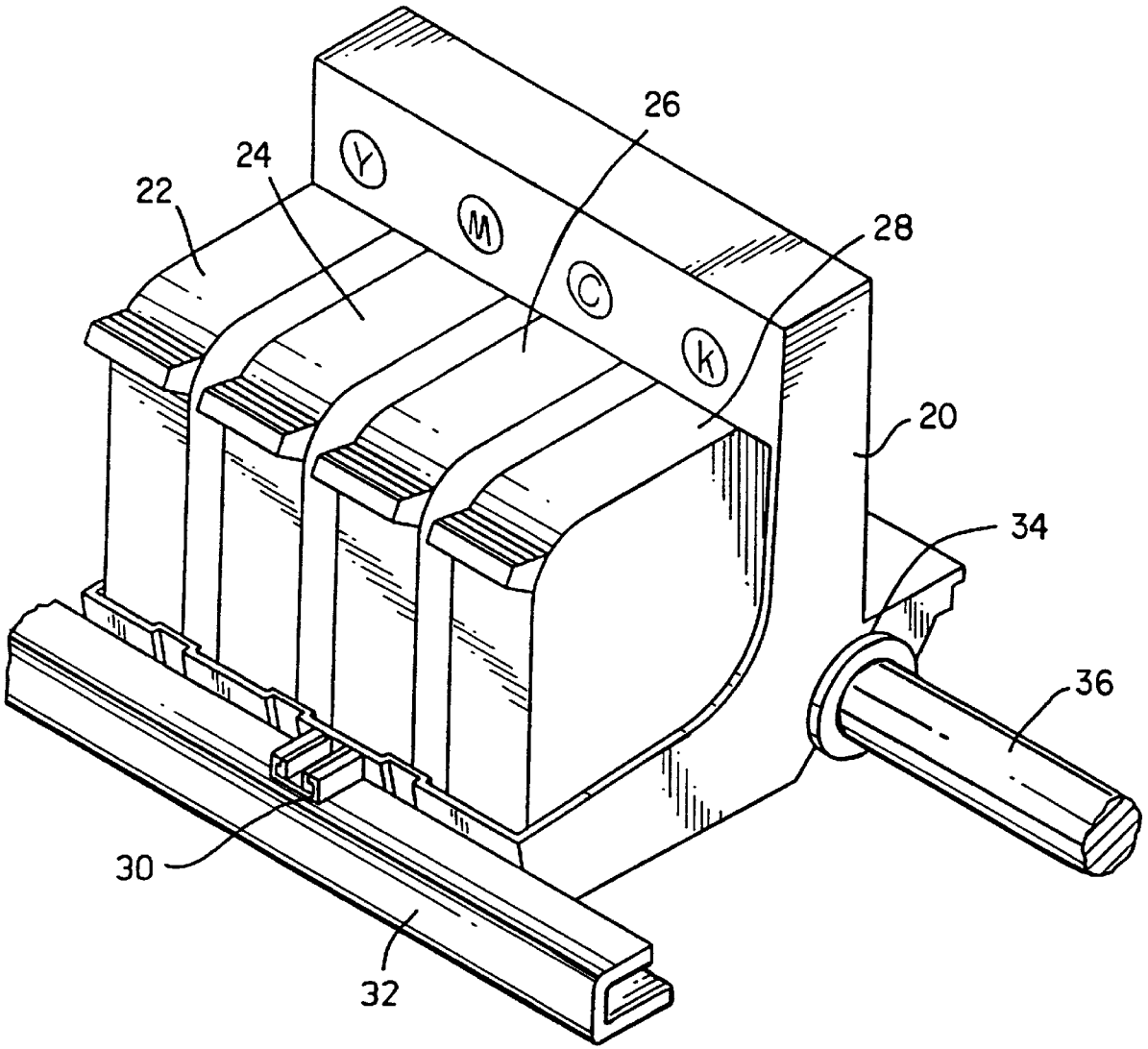
FIG. 2 is a perspective view of the carriage of the inkjet printer of FIG. 1, with yellow (Y) magenta (M), cyan (C) and black (K) inkjet cartridges removably mounted in the carriage.

Even though the invention can be used in any printing environment where text and/or graphics are applied to media using monochrome and/or color components, the presently preferred embodiment of the invention is used in an inkjet printer of the type shown in FIG. 1. In particular, inkjet printer 10 includes an input tray 12 containing sheets of media 14 which pass through a print zone, and are fed past an exit 18 into an output tray 16. Referring to FIGS. 1–2, a movable carriage 20 holds print cartridges 22, 24, 26, and 28 which respectively hold yellow (Y), magenta (M), cyan (C) and black (K) inks. The front of the carriage has a support bumper 30 which rides along a guide 32 while the back of the carriage has multiple bushings such as 34 which ride along slide rod 36. The position of the carriage as it traverses back and forth across the media is determined from an encoder strip 38 in order to be sure that the various ink nozzles on each print cartridge are selectively fired at the appropriate time during a carriage scan.

Of course, the invention is applicable to printers wherein cartridge printheads are completely or partially staggered relative to each other in the direction of the media advance axis in order to provide better throughput, avoid color bleed, etc. or may be in direct alignment to provide overlapping swaths during a single pass of the carriage over a print zone. The invention provides a unique way for selectively servicing only certain individual cartridges during a given time period, or for performing some service activities at one station and other service activities at another, or for performing all services at the same time in the same station, regardless of the staggered or aligned relationship of the printheads, and all without removing the printhead cartridges from a print carriage, as described in more detail below.

Figure 15:
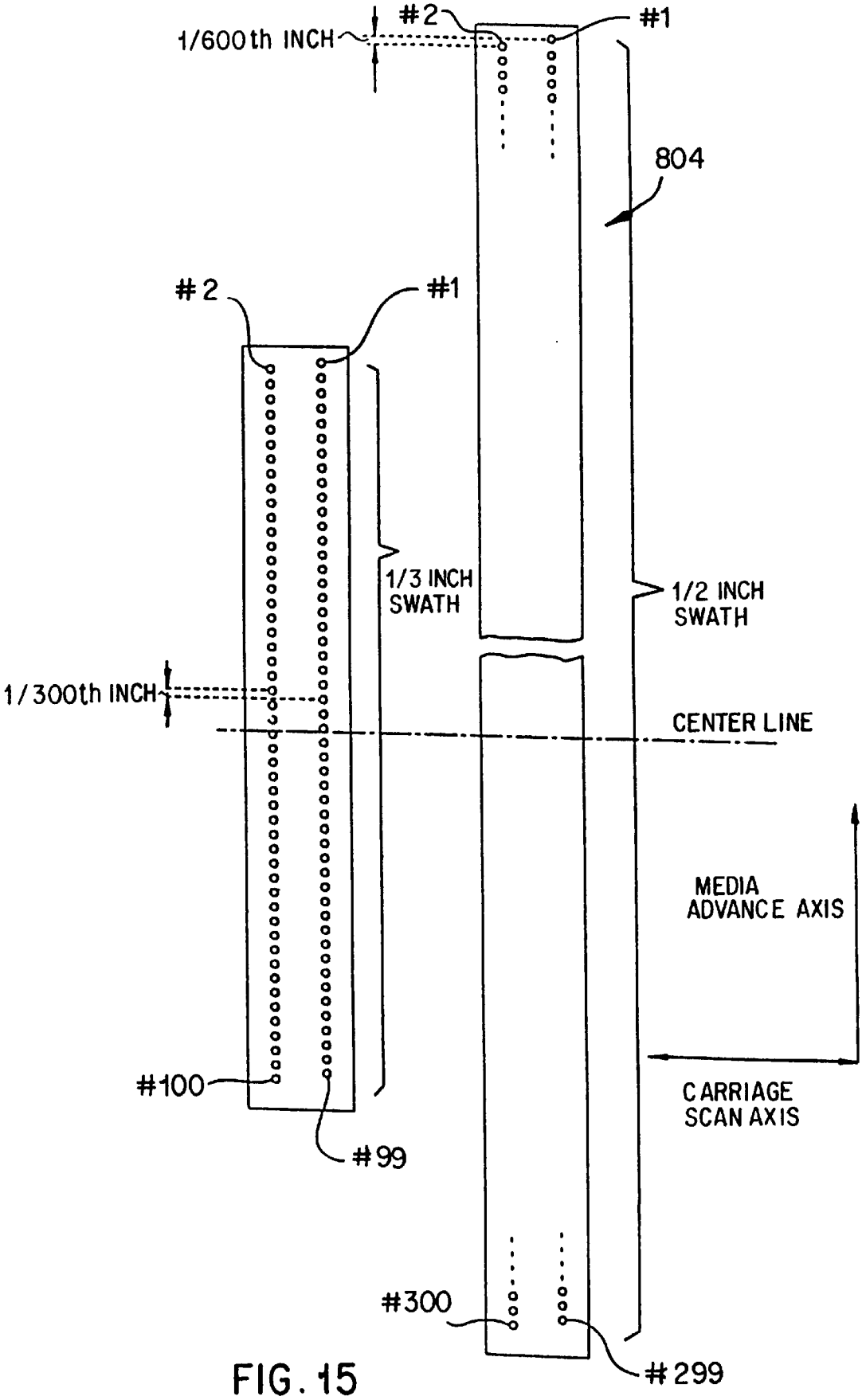
FIG. 15 schematically shows the nozzle arrays for a wide swath 600 dpi black ink printhead and a narrow swath 300 dpi color ink printhead, respectively, which can be serviced by the service station methods and techniques of the present invention.

While not limited to ink printheads having a particular type, size, resolution or configuration, the illustrated embodiment of the invention is used with ink cartridges having a double column of ink orifices which extend in the media advance axis of the printer (see FIG. 15).

In the illustrated embodiment, wiping of the three color printheads is accomplished in a conventional manner by stationary wipers having a narrow blade portion with a top edge for rubbing across the nozzle plate as the print cartridge moves past the wipers. Scraping the stationary wipers is also accomplished in a conventional manner by using a snout edge of the moving printhead. Capping of the three color ink printheads (as well as for the black ink printhead) is accomplished in a conventional manner by a capper having four sets of perimeter lips for completely surrounding the orifice pattern without overlapping any outer edge of the nozzle plate. Priming of the three color ink printheads (as well as for the black ink printhead) is accomplished in a conventional manner by a vacuum primer.

Figure 3:
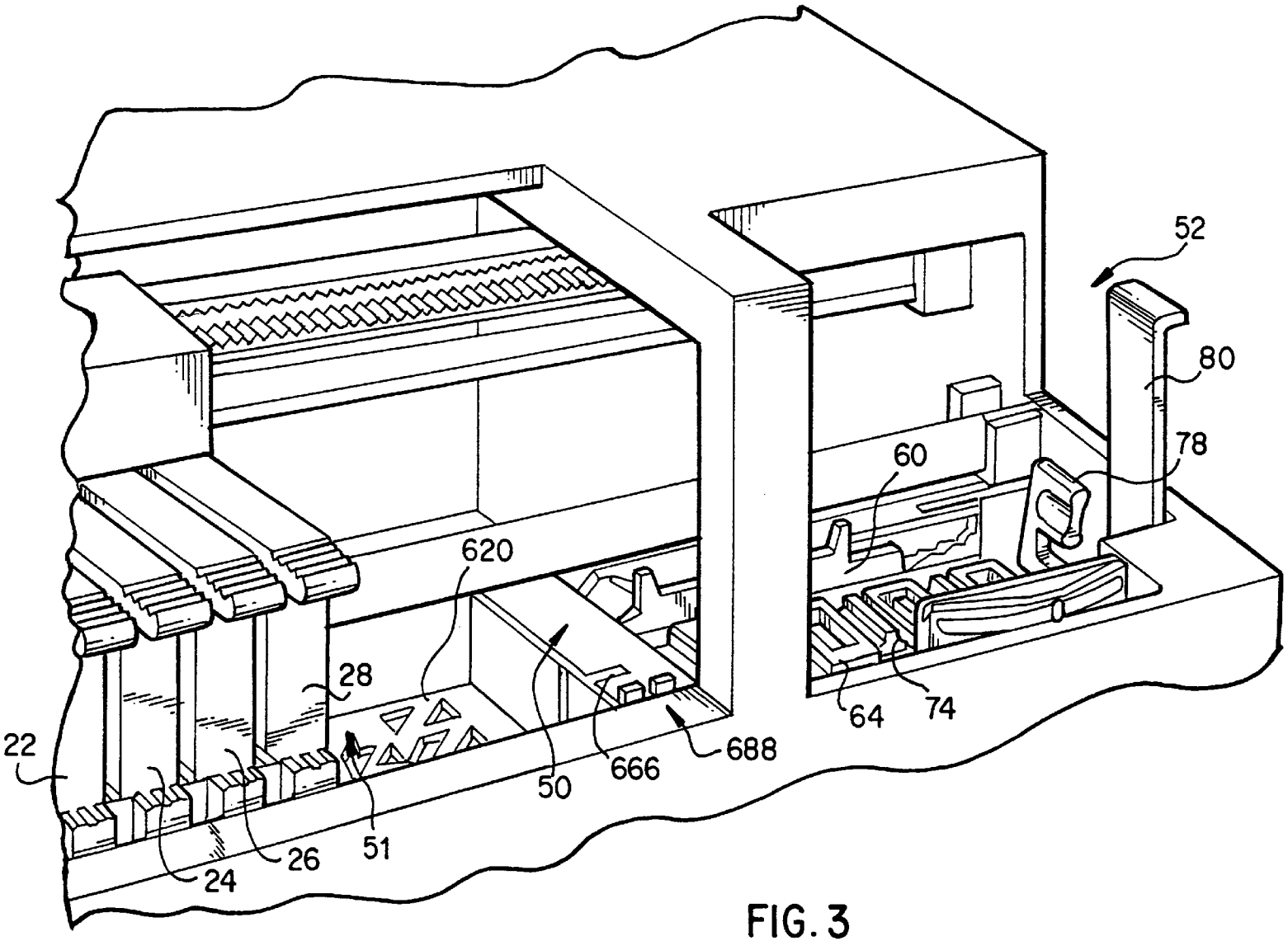
FIG. 3 it a close-up perspective view of a presently preferred embodiment of a service station unit which has been installed in the inkjet printer of FIG. 1.
Figures 4A, 4B:
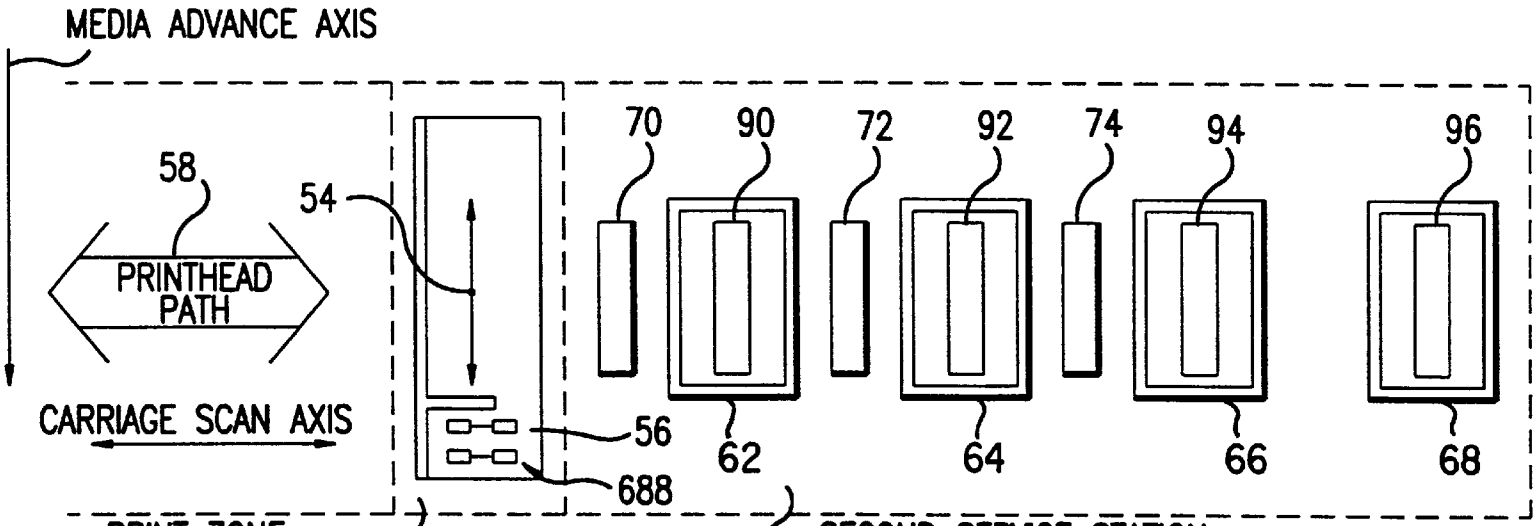
FIGS. 4A and 4B are tabular and schematic representations showing the allocation of printhead services between first and second service stations which are incorporated in the service station unit of FIG. 3.

However, as shown in FIGS. 3 and 4A–4B, the service station functions of the present invention are generally divided between a first service station 50 which is immediately on the right of a print zone 51 and a second service station 52 which is on the right of the first service station. The service functions of each are set forth in tabular form in FIG. 4A, and shown schematically in FIG. 4B. The direction of the translational back-and-forth wiping of the 600 dpi pigment based black ink printhead is identified by arrow 54 which is orthogonal to the carriage scan axis. Moreover, a home location 56 for parking wiper blade member 688 during an actual printing operation is located away from printhead path 58, to avoid interference with any of the printheads which extend into the service station section of the printer at the end of each printing swath.

Figure 5:
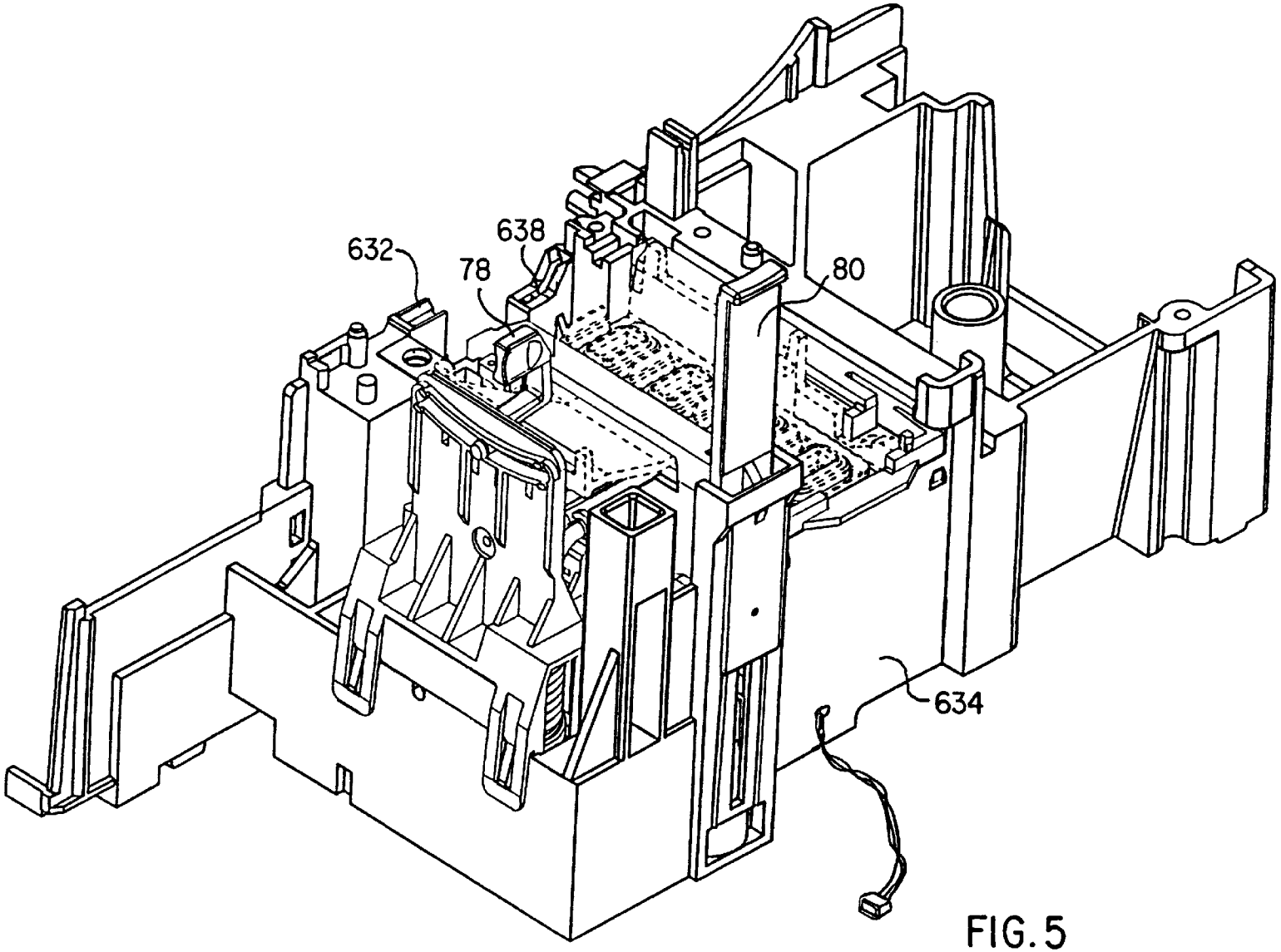
FIG. 5 is a perspective view of a housing portion of the service station unit of FIG. 3, with certain functional components of the second service station shown in dotted lines.
Figure 6:
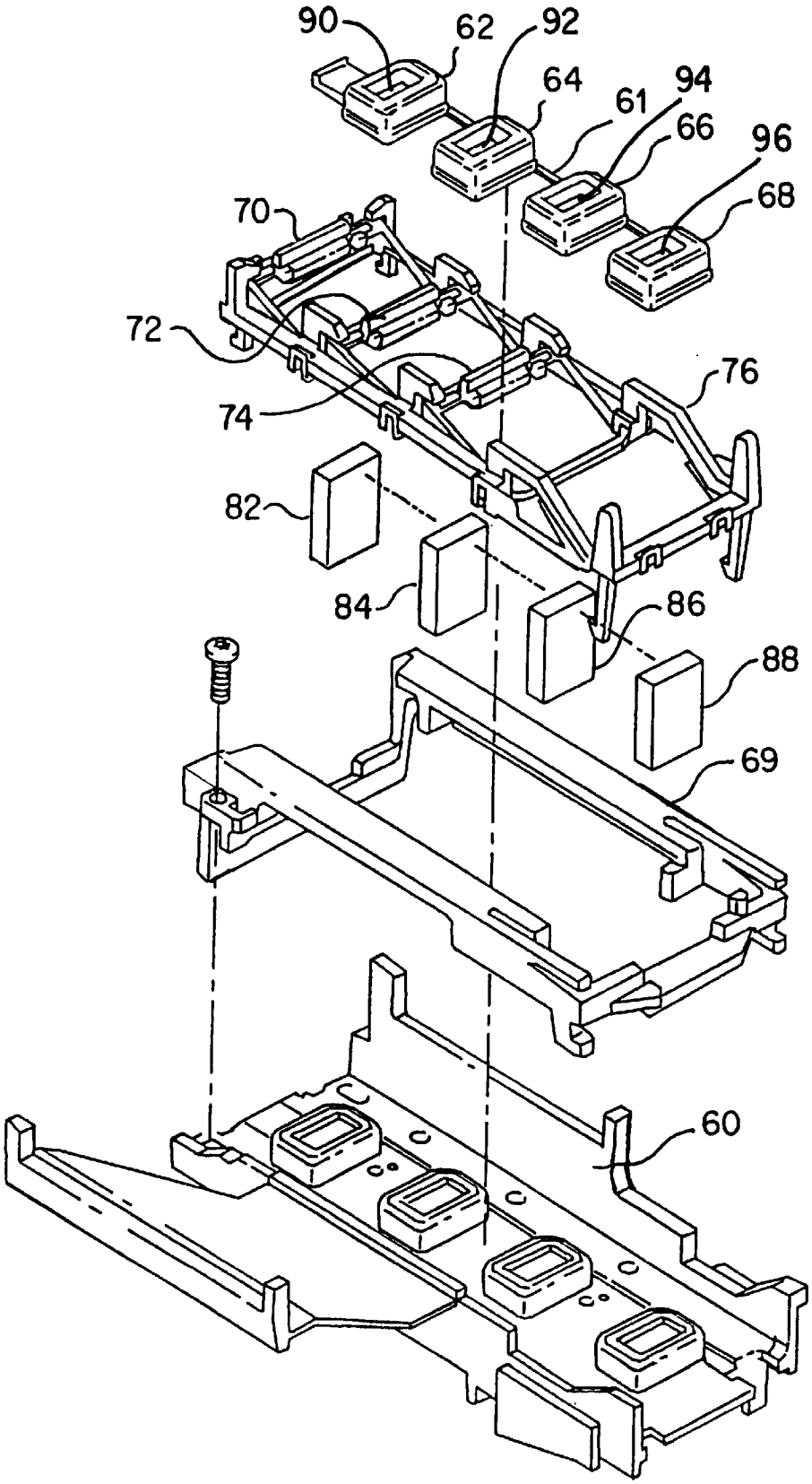
FIG. 6 is an exploded view of the functional service station components of the second service station, previously shown in dotted lines in FIG. 5.

Referring now to FIGS. 3, 5 and 6, the second service station 52 includes sled 60 having a bar 61 for holding caps 62, 64, 66, 68. When the carriage 20 is not being used for printing and is not in position at the first service station, the carriage moves all the way to the right to enable the caps to engage their respective printhead nozzle surfaces, thereby preventing the ink orifices in the printhead from drying out.

A wiper support structure 69 rests on the sled 60. Three wiper blades 70, 72, 74 are each mounted with spring loading on a frame 76 for the CYM printheads, respectively, to remove contaminants or crusted ink that may block the printhead nozzles. Each wiper is dedicated exclusively to only one of the color ink printheads, while wiper blade member 688 in the first service station is dedicated exclusively to only the black ink printhead.

The second service station also provides for selective priming each individual CYMK printhead by moving a selection lever 78 to align with an appropriate cartridge, and then manually depressing plunger 80. Air is drawn through one of filters 82, 84, 86, 88 through one of the central apertures 90, 92, 94, 96 (FIG. 4B) in each cap. Thus, if for some reason ink is no longer in the firing chamber for a particular printhead, a vacuum source (not shown) draws air through a central aperture and through the nozzle connected to a particular firing chamber, while the carriage is in the capping position in the second service station, to draw ink from an ink reservoir of the print cartridge into the firing chamber.

The "spitting" function for all four printheads is handled by the first service station. This is particularly important when cartridges have been capped for a lengthy period of time. Before resuming printing, a series of ink drops are fired in a spitting operation to clear crusted ink from the nozzles. Such spitting can be scheduled to correlate with a wiping operation for the black ink cartridge in the first station, as well as with a wiping operation for the color ink cartridges in the second station.

Figure 7:
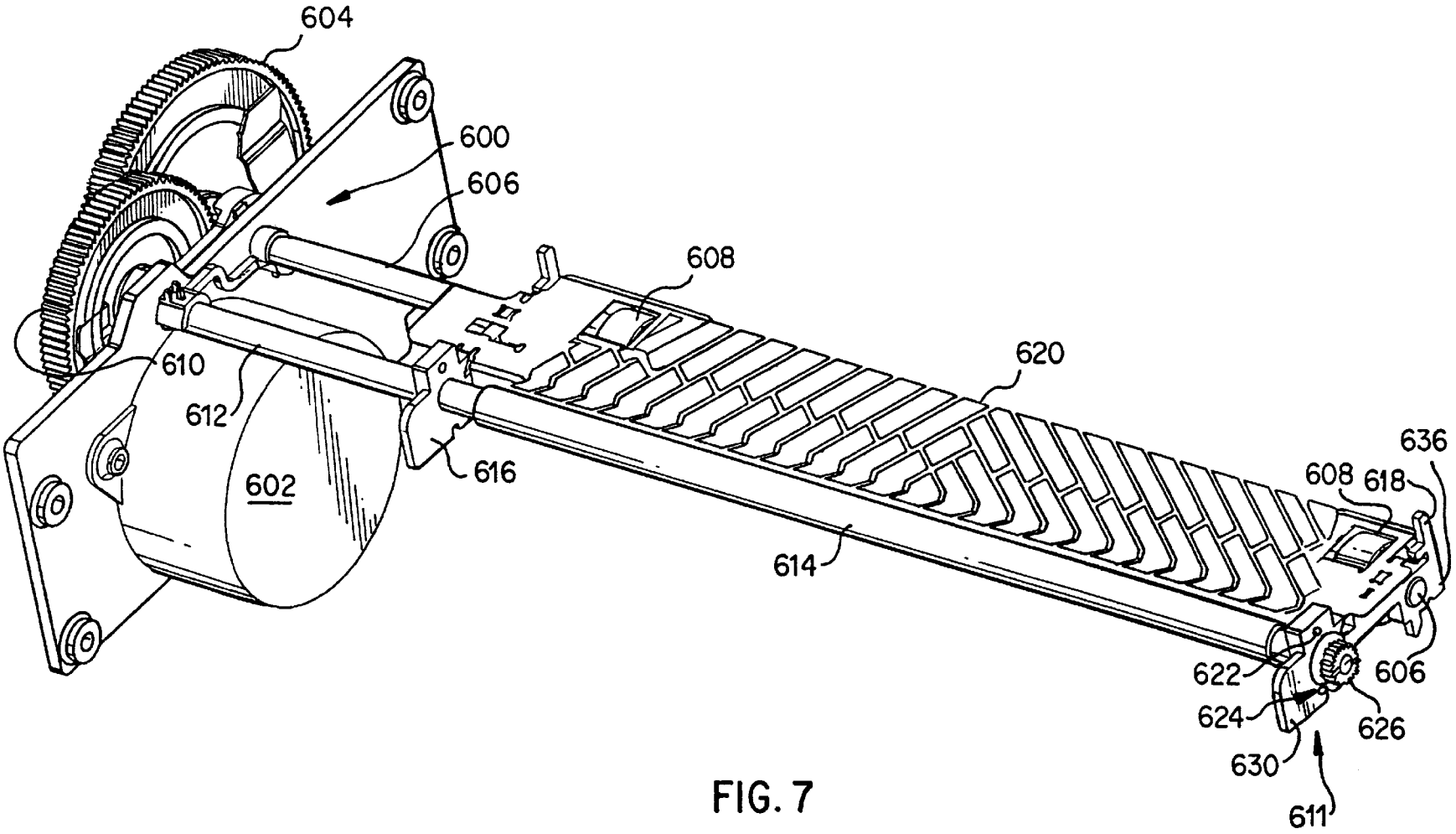
FIG. 7 is a perspective view showing a media advance drive roller system for a print zone, with a first service station drive gear mounted on one end of a media advance drive axle.
Figure 8:
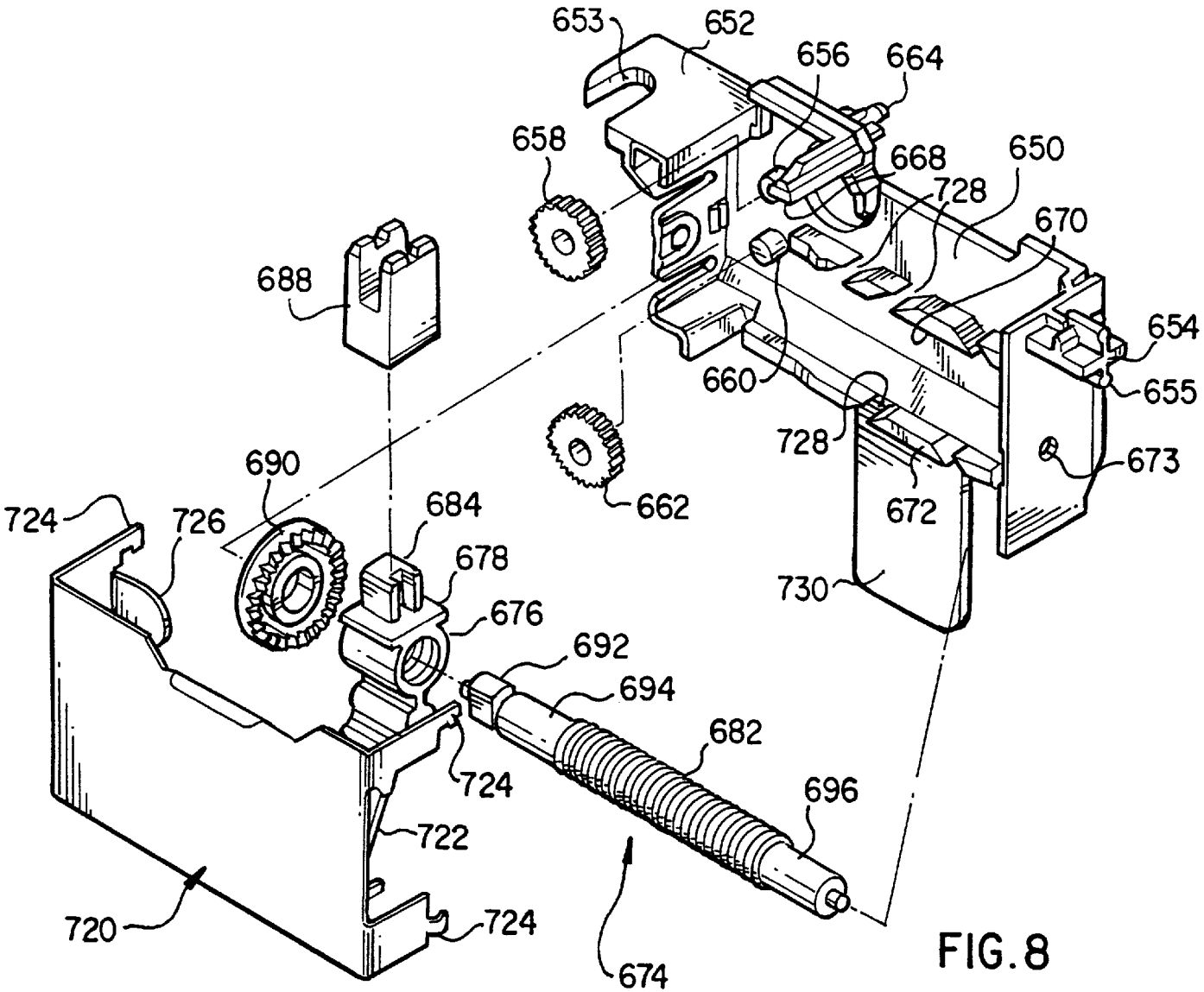
FIG. 8 is an exploded view of a first service station.
Figure 9:
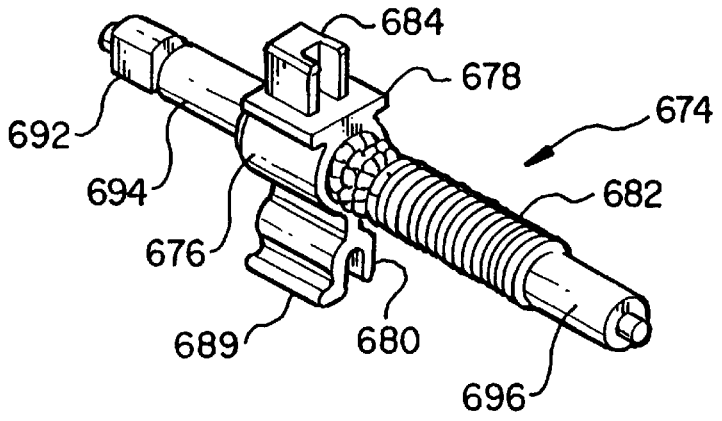
FIG. 9 shows a wiper base on a lead screw of the first service station.
Figure 10:
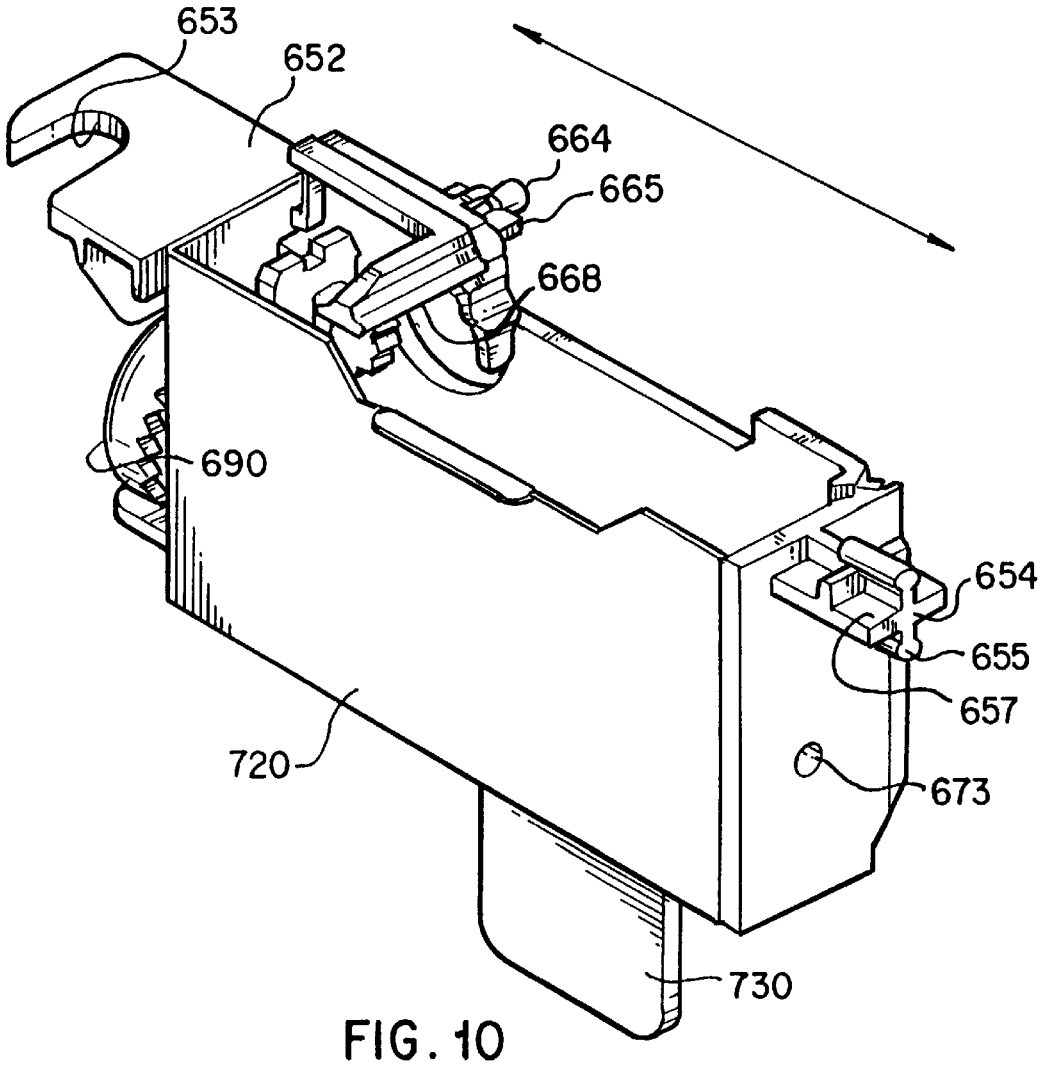
FIG. 10 is a perspective view of a first service station ready for installation on the printer, with a wiper unit in parked position.
Figure 11:
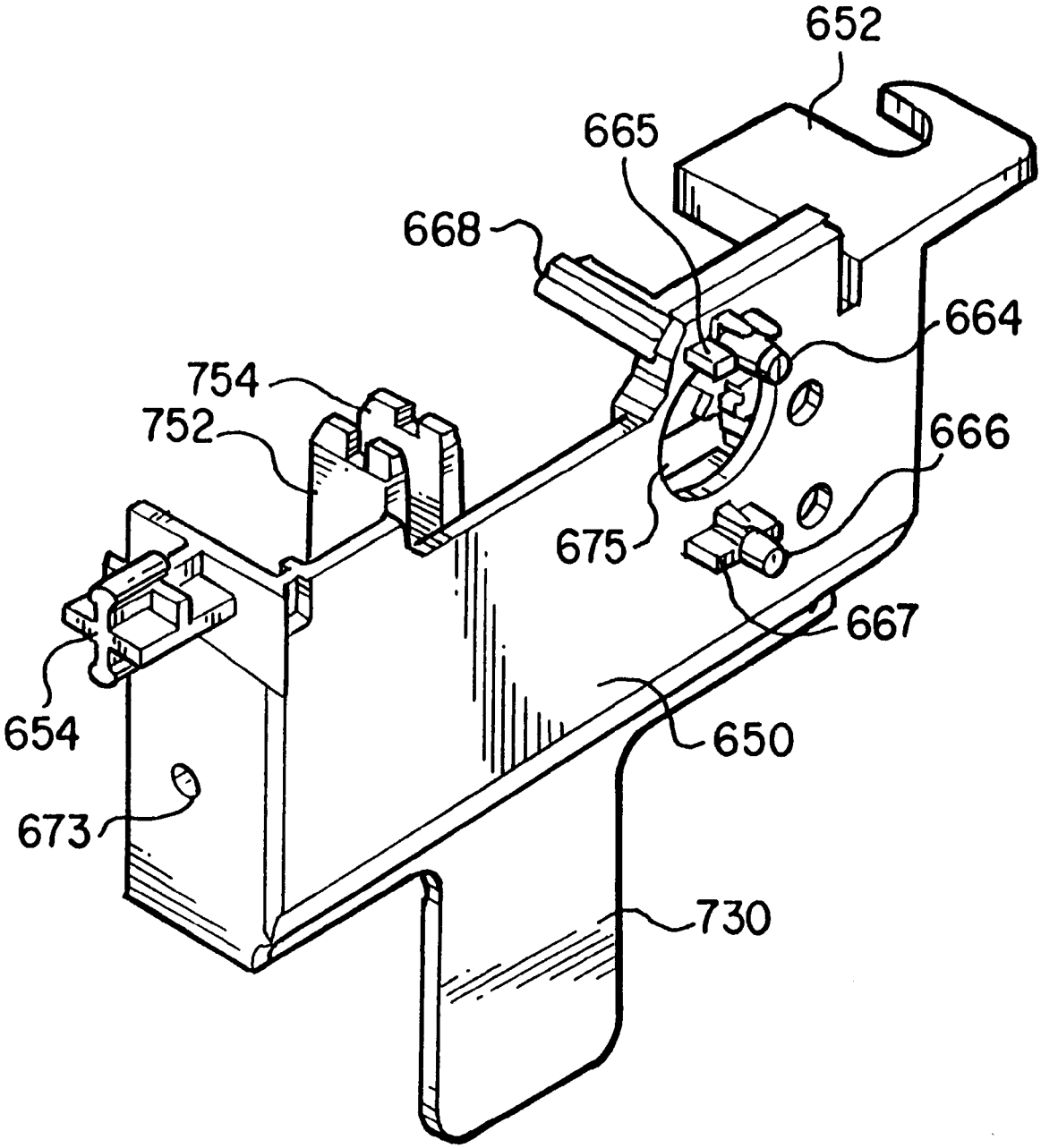
FIG. 11 is a perspective view of a housing portion of the first service station.

The perspective view of FIG. 7 shows how a first service station 50 can be actuated by a media advance motor, and also identifies one frame of reference for use in positioning a wiper unit in the first service station relative to the printhead and to the printer platen. In that regard, the media advance system for an inkjet printer with a heated print zone such as the Hewlett-Packard DeskJet 1200 C inkjet printer includes a vertical support plate 600, a stepper motor 602, a main drive gear 604 which drives a first axle 606 carrying primary drivewheels 608, a secondary drive gear 610 which drives a second axle 612 carrying secondary driveroller 614. Left and right bushing plates 616, 618 provide precise positioning of the drivewheels 608 and the driveroller 614 closely adjacent to a screen platen 620 which supports media passing through a heated print zone.

In the present invention, the right bushing plate 618 is modified to provide precise positioning of a unique first service station unit which is located next to the right bushing plate. The right bushing plate includes a top hole 622 and a bottom hole 624 for positional mounting of the first service station unit. A service station drive gear 626 is fixedly mounted on the right end of second axle 612. A front datum projection 630 fits into matching slot 632 (FIG. 5) on a service station chassis 634, while a rear datum projection 636 fits into another matching slot 638. Thus the service station chassis provides another frame of reference for positioning a wiper unit in the first service station relative to the printhead and to the printer platen.

The structural details of the first service station unit are best shown in FIGS. 8–11. A housing 650 includes a front mounting tab 652 with screw slot 653, back mounting tab 654 with walls 655, 657, top bearing pin 656 for rotatably mounting top spur gear 658, bottom bearing pin 660 for rotatably mounting bottom spur gear 662, externally projecting mounting members (for holes 622, 624, respectively) such as a secondary top mounting pin 664 with spacer 665 and primary bottom mounting pin 666 with spacer 667, scraper 668, upper and lower cam surfaces 670, 672, and forward and rear bearing holes 673 for rotatably mounting a lead screw 674. A large opening 675 in the housing 650 allows drive gear 626 to extend through a housing wall for engagement with spur gear 658, thereby providing a gear train through bottom spur gear 662 to face gear 690. Chassis hole 677 is positioned for attaching alignment with screw slot 653, and chassis slot 679 is positioned for engagement with walls 655, 657.

A nut member is provided to form a wiper base 676 which has upper and lower cam followers 678, 680 which respectively track upper and lower cam surfaces 670, 672 as the wiper base moves in a back-and-forth linear motion along a central threaded portion 682 of the lead screw 674. An upwardly projecting key shaft 684 on the wiper base 676 is shaped to engage a matching interior mounting channel 686 of a removable wiper blade 688. An extending toe 689 on the wiper base provides asymmetry to avoid assembling the wiper base facing in the wrong direction on the leadscrew.

The face gear 690 is mounted on a square hub 692 of the lead screw 674 as the last element in a gear train to rotatably drive the lead screw. The lead screw 674 includes unthreaded front and back portions 694, 696 to provide temporary parking positions for the wiper base after it has traversed along the central threaded portion 682 during rotation of the lead screw by the face gear.

A cover 720 is sized and shaped to fit together with the housing 650 to form a spittoon in the first service station. The cover includes a front spring arm (not shown) and a back spring arm 722 to urge the wiper base into engagement with the central threaded portion 682 during appropriate time periods of the wiping procedure. Arm hooks 724 are provided for engagement with matching slots on the housing, and tab plates 726 serve to hold the spur gears 658, 662 in position on the housing. To facilitate movement of the wiper member 688 back and forth along the lead screw, slots 728 in both upper and lower cam surfaces 670, 672 allow ink to descend down into a bottom spittoon area (not shown) where an enlarged diaper pad absorbs excess ink. Also, an elongated wicking member 730 extends downwardly from the housing to help draw residual liquid ink down and away from important moving printer parts and away from the print zone. The back-and-forth movement of the wiper member 688 also helps to avoid crippling buildup of ink in the spittoon.

Figure 12B:
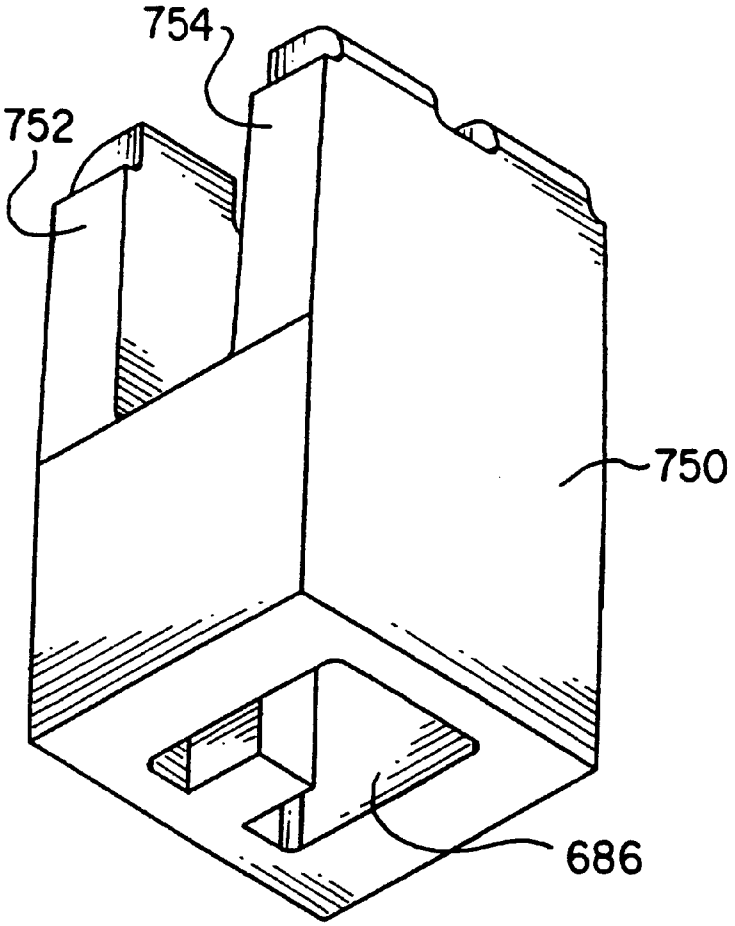
FIGS. 12A and 12B are enlarged perspective top and bottom views, respectively, of a wiper blade component of the first service station.
Figure 12A:
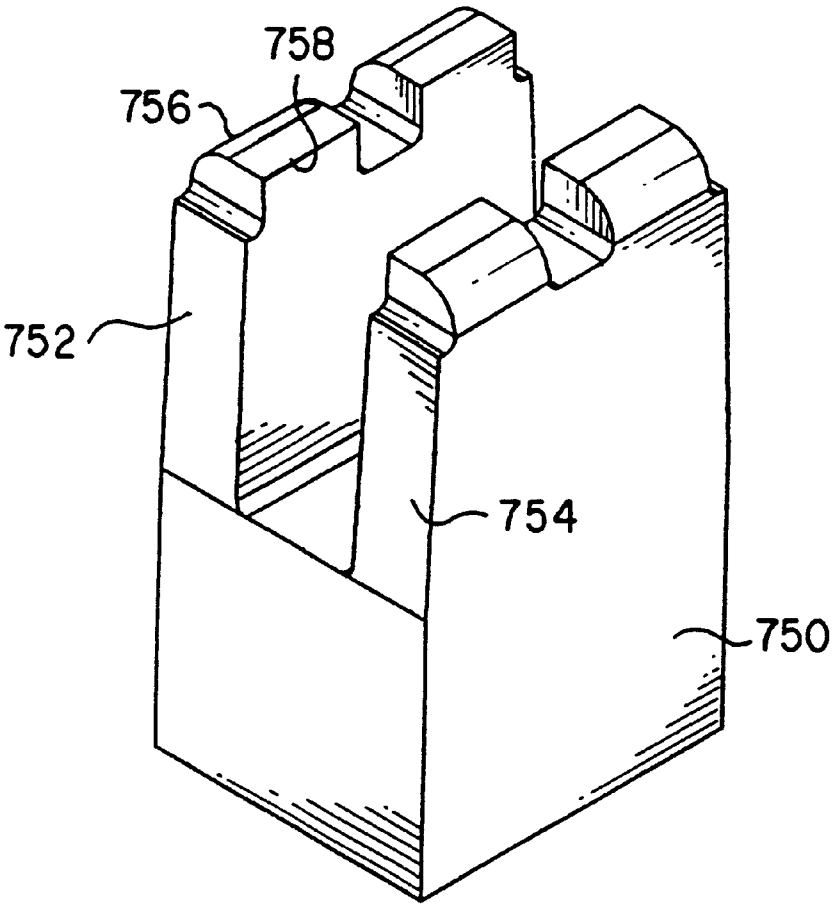
Figure 13:
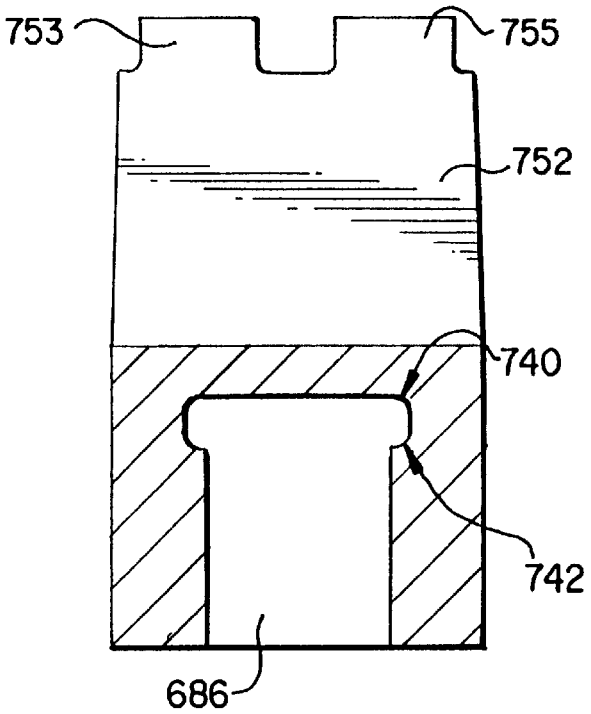
FIG. 13 is a partially sectional view showing an interior mounting channel of the wiper blade component of FIGS. 12A and 12B.
Figure 14:
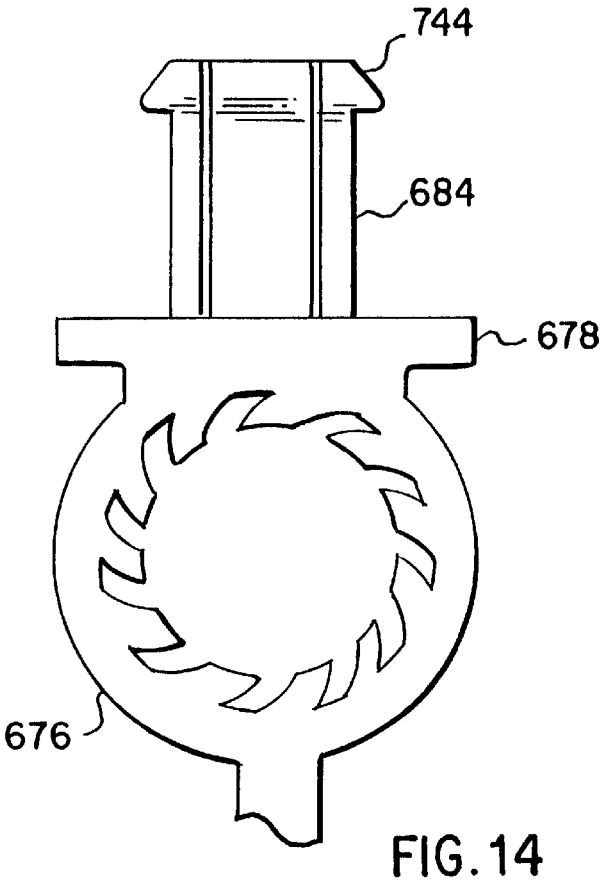
FIG. 14 is a partial side view of a wiper base showing a key shaft for engagement with the interior mounting channel of FIG. 13.

As shown in FIGS. 12A–12B and 13, secure but removable attachment of a wiper blade member 750 made with an elastomer material such as EPDM rubber is provided by an end wall 740 and a lateral headwall 742 for receiving and engaging splayed head 744 on wiper base 684 (FIG. 14). Wiper blade member 750 includes successive wiper blades 752, 754 which are split to form separate spaced apart wiping sections 753, 755. Each section presents a rounded edge 756 and a sharp edge 758 to sequentially wick ink from orifices onto a nozzle surface of the printhead with the rounded wiper edge and immediately thereafter remove ink from the nozzle surface of the printhead with the sharp wiper edge. By positioning the successive wiper blades in a mirror image orientation, the rounded wiper edge necessarily engages the nozzle surface first and the sharp edge engages the nozzle surface immediately thereafter. Thus, wet ink resolubalizes any dried ink on the nozzle surface, and the sharp edge immediately cleans the surface before any dried ink buildup occurs. The aforementioned split configuration is particularly designed for use with inkjet nozzle arrays having two columns of ink orifices, such as a ⅓ inch swath printhead 802 with approximately one hundred nozzles in a 300 dpi array and/or a ½ inch swath printhead 804 with approximately three hundred nozzles in a 600 dpi array (see FIG. 15).

Figure 16A:
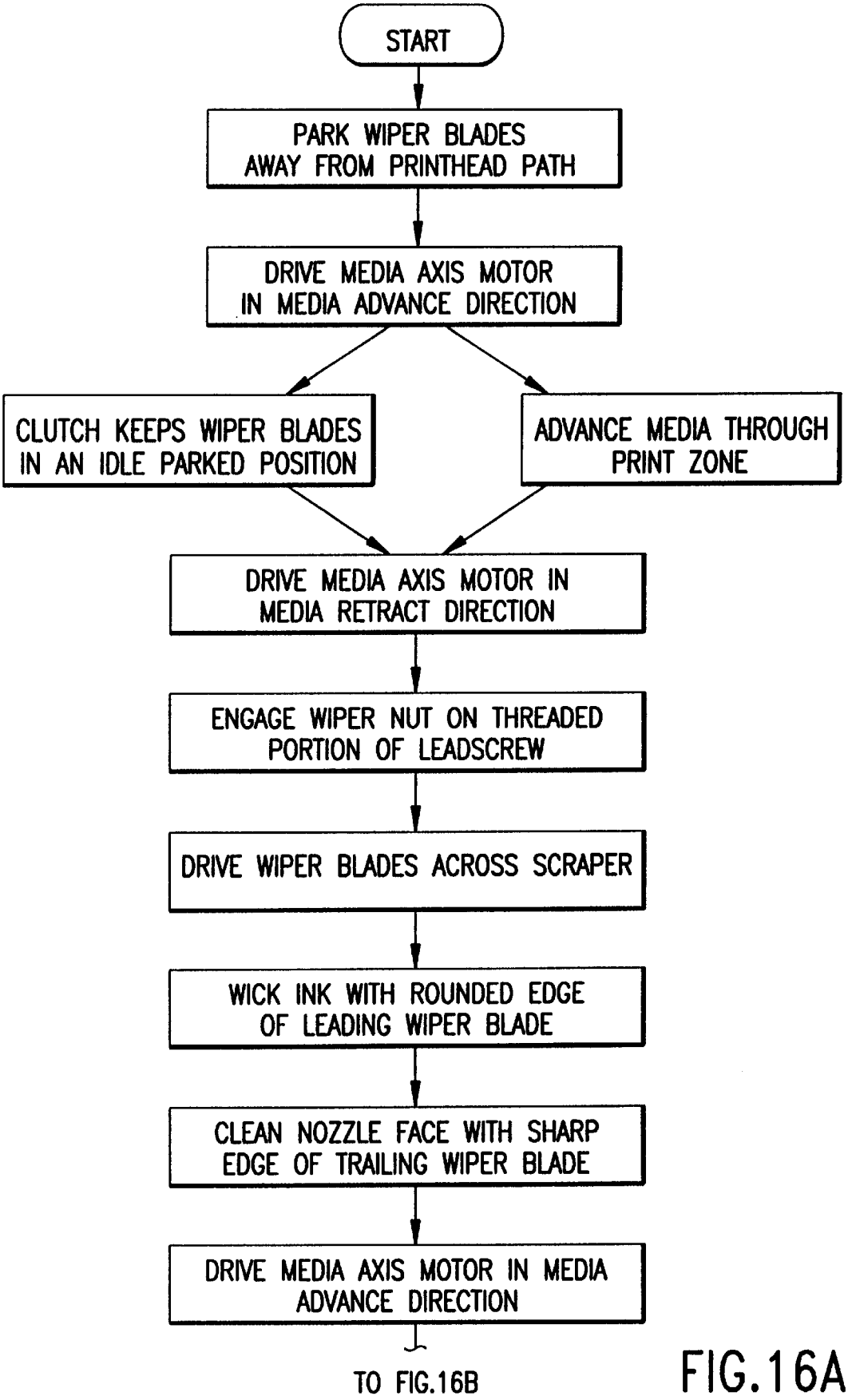
FIGS. 16A and 16B are a flow chart showing the service station methods and techniques of the first service station.
Figure 16B:
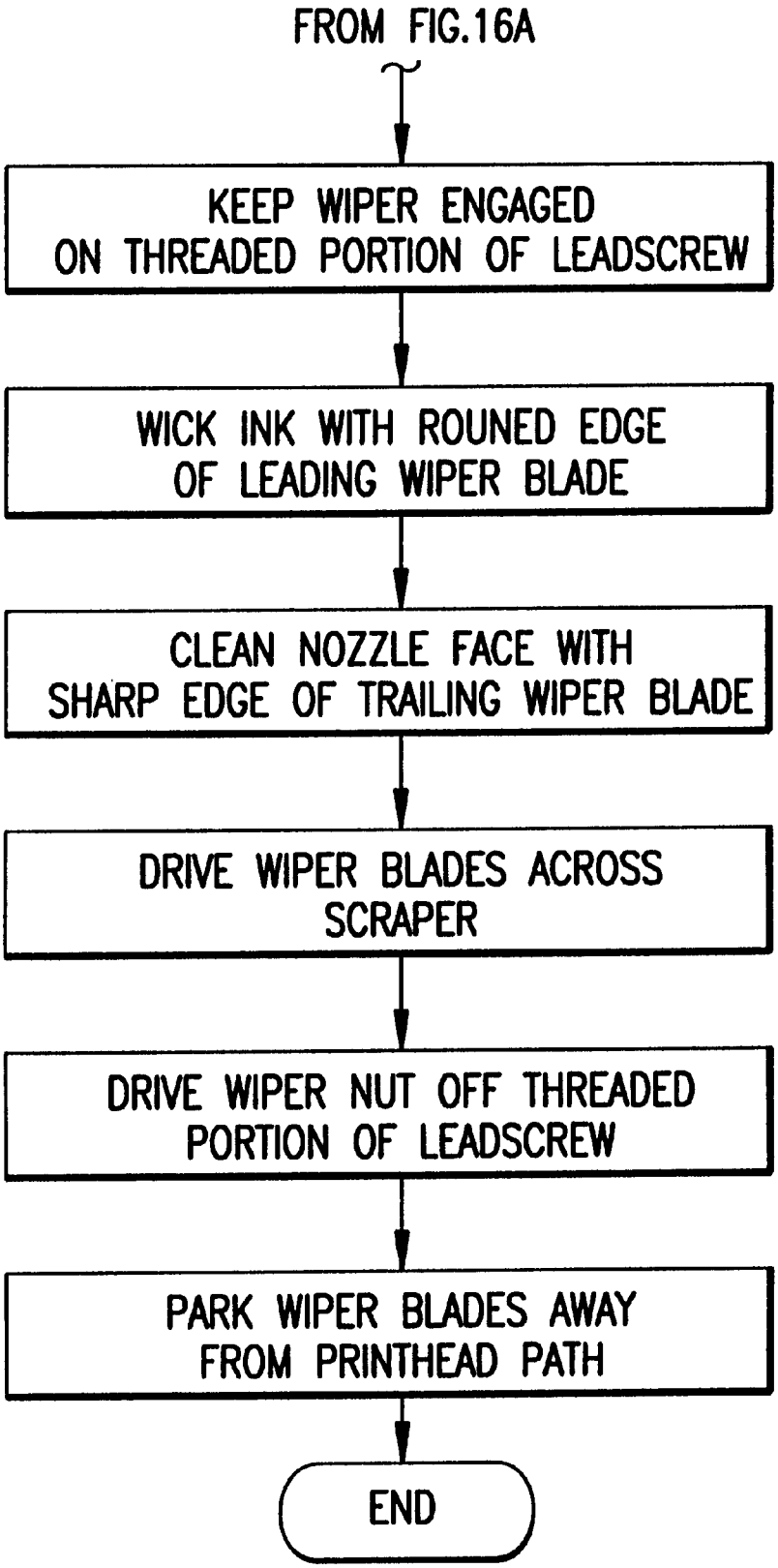

In accordance with all of the foregoing, the first service station provides for the unique wiping/scraping procedure as set forth in the flow chart of FIGS. 16A–16B. It will be understood from the self-explanatory flow chart that initially the wiper blades are parked in an idle position with the wiper base in a home position on the unthreaded portion of the lead screw, even though the lead screw continues to rotate during a printing operation. After the printing operation is completed and the media is advanced out of the print zone, a scheduled wiping operation is commenced by reversing the stepper motor to activate the first service station. As the threads of the lead screw engage the wiper nut, the flexible wiper blade edges are first driven across the rigid scraper to clean them in order to avoid damaging the nozzle surface, and then are driven across the ink orifices for the wicking/cleaning actions previously described. The cycle is completed by reversing the stepper motor to again accomplish the wicking/cleaning actions followed by the step of scraping the flexible wiper blade edges. The threaded wiper base then moves into an idle or parked position due to the clutch action of the unthreaded portion of the lead screw. It is to be noted that while the accumulation of ink on a nozzle surface of the printhead is normally an undesirable thing, in this instance the wicking of ink from a nozzle array by the rounded edge of the leading wiper blade is very important here to achieve successful cleaning of the nozzle surface by lubricating the nozzle surface and by resolubalizing any residual dried ink on the nozzle surface.

Figure 17:
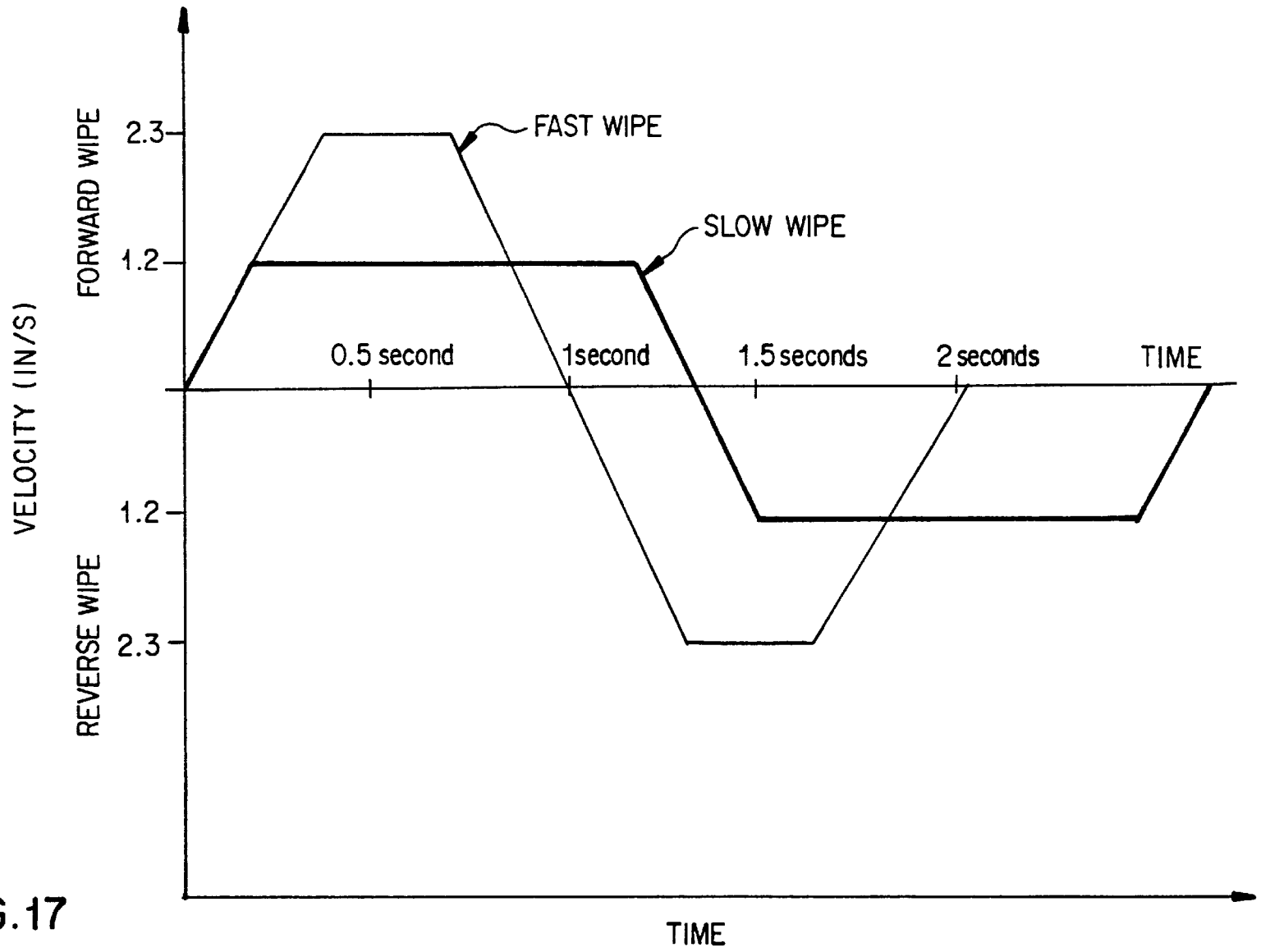
FIG. 17 is a timing diagram for a complete wiping cycle of the first service station.

The different wiping speeds and the time required to perform each full wiping cycle in the preferred embodiment of the invention are shown in the timing diagram of FIG. 17. Thus, translational wiping is accomplished in both directions at different speeds as determined by print quality reliability standards.

It will be appreciated by those skilled in the art that the various datum mechanical interconnects precisely position the wiping mechanism of the first service station. If the media advance axis is called the X-axis, then primary positioning in the X direction is provided by lower pin 666. A first rotational positioning is provided by wall 657 and tab 652. A second rotational positioning is provided primarily by spacers 665, 667. Additional rotational positioning about the Z-axis is provided by lower wall 655 and spacers 665, 667.

By providing specialized wiping services to a high resolution wide swath pigment based black ink pen, this invention allows higher resolution and speed to occur for frequently printed features such as text and the most frequent color components of graphics—viz, black. Thus by printing these frequent features and components faster and at a higher resolution, the entire page is faster and of higher quality and is more comparable with laser printing performance (8+ pages per minute) and laser printing quality (600 dpi resolution).

It should be understood that the foregoing description is only illustrative of the invention. Various alternatives and modifications may be made by those skilled in the art without departing from the spirit of the invention. Accordingly, the present invention is intended to include all such alternatives, modifications and variations which fall within the scope of the following claims.

We claim as our invention:

1. An inkjet printer for use with at least one printhead with multiple orifices on a nozzle surface for applying liquid ink to media in a print zone, comprising:

a frame;

a service station on said frame;

a carriage slidably mounted on said frame and movable in a carriage scan direction across the print zone to a stop position in said service station, with the printhead moving along a printhead path; and a wiper unit located in said service station and having a wiper member and means for moving the wiper member back and forth in linear forward and reverse wiping directions across the multiple orifices to perform a wiping operation on the nozzle surface of the printhead when said carriage is in said stop position in said service station.

2. The inkjet printer of claim 1 wherein said wiper unit includes a wiper member which moves in a linear direction which is orthogonal to said carriage scan direction.

3. The inkjet printer of claim 1 wherein said wiper member includes a plurality of successive wiper blades which are in close proximity to each other for sequential wiping of the same printhead in a forward wiping direction.

4. The inkjet printer of claim 3 wherein one of said successive wiper blades draws ink out of the ink orifices onto the nozzle surface, and another of said successive wiper blades wipes ink off the nozzle surface.

5. The inkjet printer of claim 1 wherein said wiper member includes a plurality of successive wiper blades which are in close proximity to each other for sequential wiping of the same printhead in both forward and reverse wiping directions.

6. The inkjet printer of claim 1 wherein the wiper member includes at least one rounded edge portion and at least one sharp edge portion such that initially wiping said printhead with said rounded edge portion draws ink onto said nozzle surface and subsequently wiping said printhead with said sharp edge portion wipes ink off said nozzle surface.

7. The inkjet printer of claim 1 wherein said wiper member includes at least one resilient wiper with sufficient thickness to have a rounded edge portion and a sharp edge portion such that wiping said printhead in one direction with said resilient wiper engages said rounded edge portion with said nozzle surface of said printhead, and wiping said printhead in a reverse direction engages said sharp edge portion with said nozzle surface of said printhead.

8. The inkjet printer of claim 1 wherein the printhead includes at least one column of ink orifices extending in a given direction which is substantially parallel to said linear direction of movement of said wiper member.

9. The inkjet printer of claim 8 wherein the printhead includes two columns of ink orifices extending in a given direction which is substantially parallel to said linear direction of movement of said wiper member, and wherein said wiper unit includes a wiper blade which is split to form a first edge portion for wiping one of said columns of ink orifices and a second edge portion for wiping another of said columns of ink orifices.

10. A method of servicing an inkjet printhead having a printhead in a carriage which moves in a carriage scan direction along a printhead path through a print zone, comprising the following steps:

transporting the carriage to a stop position in a printer service station without removing the printhead from the carriage; and moving a wiper blade in the service station in a linear direction orthogonal to the carriage scan direction thereby wiping across ink orifices on a nozzle surface on the printhead, said moving step including an initial wiping step drawing ink out of the ink orifices onto the nozzle surface and a subsequent wiping step removing ink off the nozzle surface.

11. The method of claim 10 wherein said moving step includes moving the wiper blade in a back-and-forth cycle by traveling completely across an array of ink orifices on the nozzle surface in a forward direction and thereafter returning completely back across the same array of ink orifices on the nozzle surface in a reverse direction.

12. The method of claim 11 wherein said traveling and said returning steps each include initially drawing ink out of the ink orifices onto the nozzle surface and subsequently removing ink off of the nozzle surface.

13. An inkjet printer system for applying ink to media in a print zone, comprising:

a frame;

a first service station on said frame;

a second service station on said frame;

a printhead;

liquid ink;

an ink reservoir for holding said liquid ink and connected with said printhead to supply said ink to multiple ink orifices on a nozzle surface of said printhead;

a carriage for holding said printhead and slidably mounted on said frame for traveling in a carriage scan direction across the print zone to first and second stop positions in said first and second service stations respectively, with the printhead moving along a printhead path;

a wiper unit located in said first service station and having a wiper member which moves in a linear direction across said multiple ink orifices to perform a wiping operation on the nozzle surface of the printhead when the carriage is in said first stop position in said first service station; and at least one cap located in said second service station for engaging the nozzle surface of the printhead when said carriage is in said second stop position in said second service station.

14. The inkjet printer of claim 13 wherein said printhead includes a nozzle array with a resolution of 300 dpi or greater.

15. The inkjet printer of claim 13 wherein said liquid ink includes pigment-based ink.

16. The inkjet printer of claim 13 wherein said liquid ink includes black pigment-based ink.

17. The inkjet printer of claim 13 wherein said printhead includes a nozzle array having a swath width of one third inch or greater.

18. The inkjet printer of claim 13 wherein said printhead includes a nozzle array having a total of approximately three hundred ink orifices in multiple columns.

19. An inkjet printer for use with at least one printhead with multiple orifices on a nozzle surface for applying liquid ink to media in a print zone, comprising:

a frame;

a service station on said frame;

a carriage slidably mounted on said frame and movable in a carriage scan direction across the print zone to a stop position in said service station, with the printhead moving along a printhead path; and a wiper unit located in said service station and having a wiper member comprising a plurality of successive wiper blades which are in close proximity to each other for sequential wiping of the same printhead in a forward wiping direction, and means for moving the wiper member back and forth in a linear direction across the multiple orifices to perform a wiping operation on the nozzle surface of the printhead when said carriage is in said stop position in said service station, wherein one of said successive wiper blades draws ink out of the ink orifices onto the nozzle surface, and another of said successive wiper blades wipes ink off the nozzle surface.

20. An inkjet printer for use with at least one printhead with multiple orifices on a nozzle surface for applying liquid ink to media in a print zone, comprising:

a frame;

a service station on said frame;

a carriage slidably mounted on said frame and movable in a carriage scan direction across the print zone to a stop position in said service station, with the printhead moving along a printhead path; and a wiper unit located in said service station and having a wiper member and means for moving the wiper member back and forth in a linear direction across the multiple orifices to perform a wiping operation on the nozzle surface of the printhead when said carriage is in said stop position in said service station, and wherein the wiper member includes at least one rounded edge portion and at least one sharp edge portion such that initially wiping said printhead with said rounded edge portion draws ink onto said nozzle surface and subsequently wiping said printhead with said sharp edge portion wipes ink off said nozzle surface.

21. An inkjet printer for use with at least one printhead with multiple orifices on a nozzle surface for applying liquid ink to media in a print zone, comprising:

a frame;

a service station on said frame;

a carriage slidably mounted on said frame and movable in a carriage scan direction across the print zone to a stop position in said service station, with the printhead moving along a printhead path; and a wiper unit located in said service station and having a wiper member and means for moving the wiper member back and forth in a linear direction across the multiple orifices to perform a wiping operation on the nozzle surface of the printhead when said carriage is in said stop position in said service station, and wherein said wiper member includes at least one resilient wiper with sufficient thickness to have a rounded edge portion and a sharp edge portion such that wiping said printhead in one direction with said resilient wiper engages said rounded edge portion with said nozzle surface of said printhead, and wiping said printhead in a reverse direction engages said sharp edge portion with said nozzle surface of said printhead.

22. An inkjet printer having a service station and at least one printhead including a nozzle surface with multiple orifices mounted on a carriage moveable along a rectilinear path of travel across a print zone to a stop position in the service station, comprising:

a wiper unit located in said service station and having a wiper member mounted for linear movement to perform a translational wiping of the printhead while the carriage is in the stop position; and motor-driven apparatus connected to the wiper member for moving the wiper member back and forth in linear forward and reverse wiping directions across the multiple orifices to perform a wiping operation on the nozzle surface of the printhead when said carriage is in said stop position in said service station.

23. The printer of claim 22 wherein said wiper member includes a plurality of successive wiper blades for sequential wiping of the same printhead in the forward wiping direction.

24. The printer of claim 22 wherein said wiper member includes a plurality of successive wiper blades for sequential wiping of the same printhead in both forward and reverse directions.

25. The printer of claim 22 wherein said wiper member includes at least one resilient wiper with sufficient thickness to have a rounded edge portion and a sharp edge portion such that wiping said printhead in one direction with said resilient wiper engages said rounded edge portion with said nozzle surface of said printhead, and wiping said printhead in a reverse direction engages said sharp edge portion with said nozzle surface of said printhead.

* * * * *